US010213010B2

(12) United States Patent
Pearce

(10) Patent No.: US 10,213,010 B2
(45) Date of Patent: Feb. 26, 2019

(54) ELECTRONIC DEVICE ROTATION ATTACHMENT

(71) Applicant: Creative Law Enforcement Resources, Inc., South Pasadena, CA (US)

(72) Inventor: Timothy Pearce, South Pasadena, CA (US)

(73) Assignee: Creative Law Enforcement Resources, Inc., South Pasadena, CA (US)

( * ) Notice: Subject to any disclaimer, the term of this patent is extended or adjusted under 35 U.S.C. 154(b) by 0 days.

(21) Appl. No.: 15/887,204

(22) Filed: Feb. 2, 2018

(65) Prior Publication Data

US 2018/0228275 A1 Aug. 16, 2018

Related U.S. Application Data

(63) Continuation-in-part of application No. 29/594,091, filed on Feb. 15, 2017, now Pat. No. Des. 819,603.

(51) Int. Cl.

| | |
|---|---|
| ***A45F 5/00*** | (2006.01) |
| ***A45F 5/10*** | (2006.01) |
| ***B25G 1/10*** | (2006.01) |
| ***B25G 3/36*** | (2006.01) |
| ***A45F 5/02*** | (2006.01) |

(52) U.S. Cl.

CPC ..... *A45F 5/10* (2013.01); *A45F 5/021* (2013.01); *B25G 1/102* (2013.01); *B25G 3/36* (2013.01); *A45F 2005/006* (2013.01); *A45F 2005/008* (2013.01); *A45F 2200/0516* (2013.01)

(58) Field of Classification Search

CPC ..... A45F 5/10; A45F 2005/006; A45F 2200/0516; A45F 2200/0525; B25G 1/102; B25G 3/36

USPC ..... 294/25; 224/217, 674

See application file for complete search history.

(56) References Cited

U.S. PATENT DOCUMENTS

| | | | | |
|---|---|---|---|---|
| 3,866,873 | A | 2/1975 | Bohli | |
| 4,202,139 | A | 5/1980 | Hong et al. | |
| 5,407,110 | A * | 4/1995 | Marsh, Jr. | A45F 5/00 224/148.6 |
| 5,647,624 | A | 7/1997 | Beshara, Jr. | |
| 5,680,977 | A | 10/1997 | Burke | |
| 5,688,011 | A * | 11/1997 | Gulley | B66C 1/105 294/74 |
| 6,109,678 | A * | 8/2000 | Esfandiari | A45C 13/22 294/137 |
| 6,550,108 | B2 | 4/2003 | Pratl | |
| 6,869,053 | B2 | 3/2005 | Adams, IV | |
| D590,386 | S | 4/2009 | Leith et al. | |
| 7,661,567 | B2 | 2/2010 | Myers | |

(Continued)

*Primary Examiner* — Dean J Kramer

(74) *Attorney, Agent, or Firm* — Smyrski Law Group, A P.C.

(57) ABSTRACT

An apparatus enabling maintaining a small electronic device is provided. The apparatus includes a base and a loop attached to the base. The loop has a length, and the loop is joined to the base at a first position at approximately 6.25 percent of the length from a first end and further joined to the base at a second position approximately 18.75 percent of the length from the first end. The loop includes an unbound section of approximately 68.75 percent of the length and the loop is further joined to the base at a third position proximate the first end.

19 Claims, 11 Drawing Sheets

(56) References Cited

U.S. PATENT DOCUMENTS

| | | | | |
|---|---|---|---|---|
| D613,292 | S | 4/2010 | Carver | |
| 7,770,728 | B2 | 8/2010 | Karen | |
| 8,479,990 | B2 | 7/2013 | Chiarini | |
| 8,528,798 | B2 * | 9/2013 | Chen | A45C 3/001 224/217 |
| 8,550,317 | B2 | 10/2013 | Hyseni | |
| D693,818 | S | 11/2013 | Webber | |
| 8,672,374 | B1 | 3/2014 | Webber | |
| 8,950,638 | B2 * | 2/2015 | Wangercyn, Jr. | H04B 1/385 224/217 |
| D733,147 | S | 6/2015 | Stevens et al. | |
| D735,695 | S | 8/2015 | Murphy | |
| 9,179,565 | B2 | 11/2015 | Cho | |
| D749,069 | S | 2/2016 | Senoff | |
| D749,083 | S | 2/2016 | Senoff | |
| D749,559 | S | 2/2016 | Senoff | |
| 9,335,790 | B2 | 5/2016 | Stotler | |
| 9,397,717 | B2 | 7/2016 | Curran | |
| D765,662 | S | 9/2016 | Kang | |
| 2007/0181620 | A1 | 8/2007 | Carver, III | |
| 2007/0295771 | A1 * | 12/2007 | Herbig | A45F 5/02 224/191 |
| 2009/0090750 | A1 | 4/2009 | Alcenat | |
| 2009/0270050 | A1 * | 10/2009 | Brown | A45F 5/00 455/90.3 |
| 2011/0266316 | A1 | 11/2011 | Ghalib et al. | |
| 2011/0284599 | A1 | 11/2011 | Sternick | |
| 2013/0119099 | A1 | 5/2013 | Interdonato | |
| 2013/0146625 | A1 | 6/2013 | Karle et al. | |
| 2013/0277991 | A1 * | 10/2013 | Wu | A45F 5/00 294/25 |
| 2013/0277992 | A1 | 10/2013 | Senoff | |
| 2014/0313118 | A1 * | 10/2014 | Brown | G06F 3/041 345/156 |
| 2015/0122852 | A1 | 5/2015 | Feng | |
| 2015/0177791 | A1 * | 6/2015 | Sasaki | A45C 13/30 361/679.55 |
| 2016/0233909 | A1 * | 8/2016 | West | H04B 1/385 |

* cited by examiner

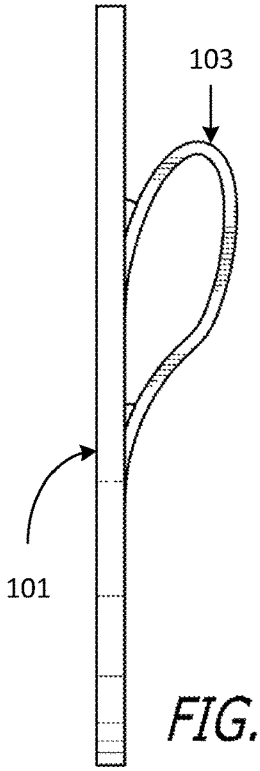
FIG. 4
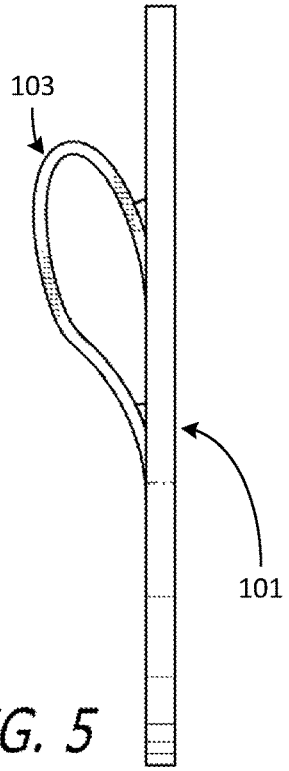
FIG. 5
FIG. 6
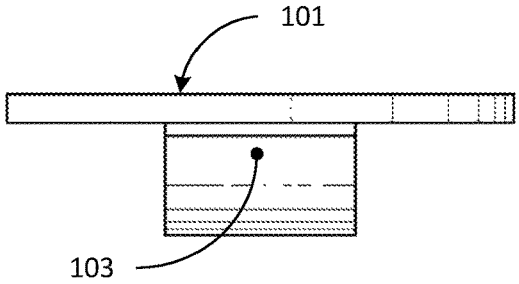
FIG. 7
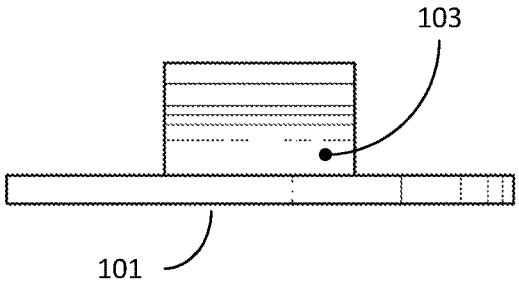

ELECTRONIC DEVICE ROTATION ATTACHMENT

The present application is claims priority based on co-pending U.S. patent application Ser. No. 29/594,091, filed Feb. 15, 2017, entitled "Electronic Device Rotation Attachment," inventor Timothy Pearce, the entirety of which is incorporated herein by reference.

BACKGROUND OF THE INVENTION

Field of the Invention

The present invention relates to peripheral devices for personal electronic equipment, and in particular to devices used with small portable electronics such as smartphones.

Description of the Related Art

Small electronic devices, such as smartphones, are becoming ubiquitous. It can be difficult to maintain these devices, i.e. to hold these devices, due to the shape of the device and the human hand. People frequently drop such devices, and in some instances, there can be an urgency in performing other tasks with one's hands while maintaining control over such devices.

Certain devices have been offered to address this issue, including but not limited to devices that effectively tether the electronic device to the user, such as to his or her finger or wrist, as well as simple rings attached to the device wherein the user can slip his or her finger or fingers through the ring so attached. However, none of these devices allow for the ability of the user to quickly and efficiently "flip" the phone such that the user can use his or her hands, or "flip" the phone back into his or her palm with minimal effort. Existing devices, such as the aforementioned tethers and rings, are either impossible to employ to repel and retract or take significant effort and are cumbersome or awkward as a result. No device currently known allows for a quick and relatively minor flick of the wrist to move away from and return to the palm of a user's hand.

Thus, there remains a need to provide a device that overcomes the drawbacks identified above.

SUMMARY OF THE INVENTION

Thus according to the present design, there is provided an apparatus comprising a base and a loop attached to the base. The loop has a length, and the loop is joined to the base at a first position at approximately 6.25 percent of the length from a first end and further joined to the base are a second position approximately 18.75 percent of the length from the first end. The loop comprises an unbound section of approximately 68.75 percent of the length and the loop is further joined to the base at a third position proximate the first end.

According to a further embodiment of the present design, there is provided a method for constructing an apparatus to maintain an electronic device, comprising providing a base and a loop having a length, attaching the loop to the base at a first position at approximately 6.25 percent of the length from a first end, further attaching the loop to the base at a second position approximately 18.75 percent of the length from the first end, further attaching the loop to the base at a third position proximate to the first end, thereby producing an unbound section of the loop of approximately 68.75 percent of the length and joining the base to the electronic device such that an axis of rotation formed by the loop is vertically offset from a centerline of the electronic device.

Various aspects and features of the disclosure are described in further detail below.

BRIEF DESCRIPTION OF THE DRAWINGS

FIG. 4 is a right side elevation view of one embodiment of the present design;

FIG. 5 is a left side elevation view of one embodiment of the present design;

FIG. 6 is a top view of one embodiment of the present design;

FIG. 7 is a bottom view of one embodiment of the present design;

DETAILED DESCRIPTION

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
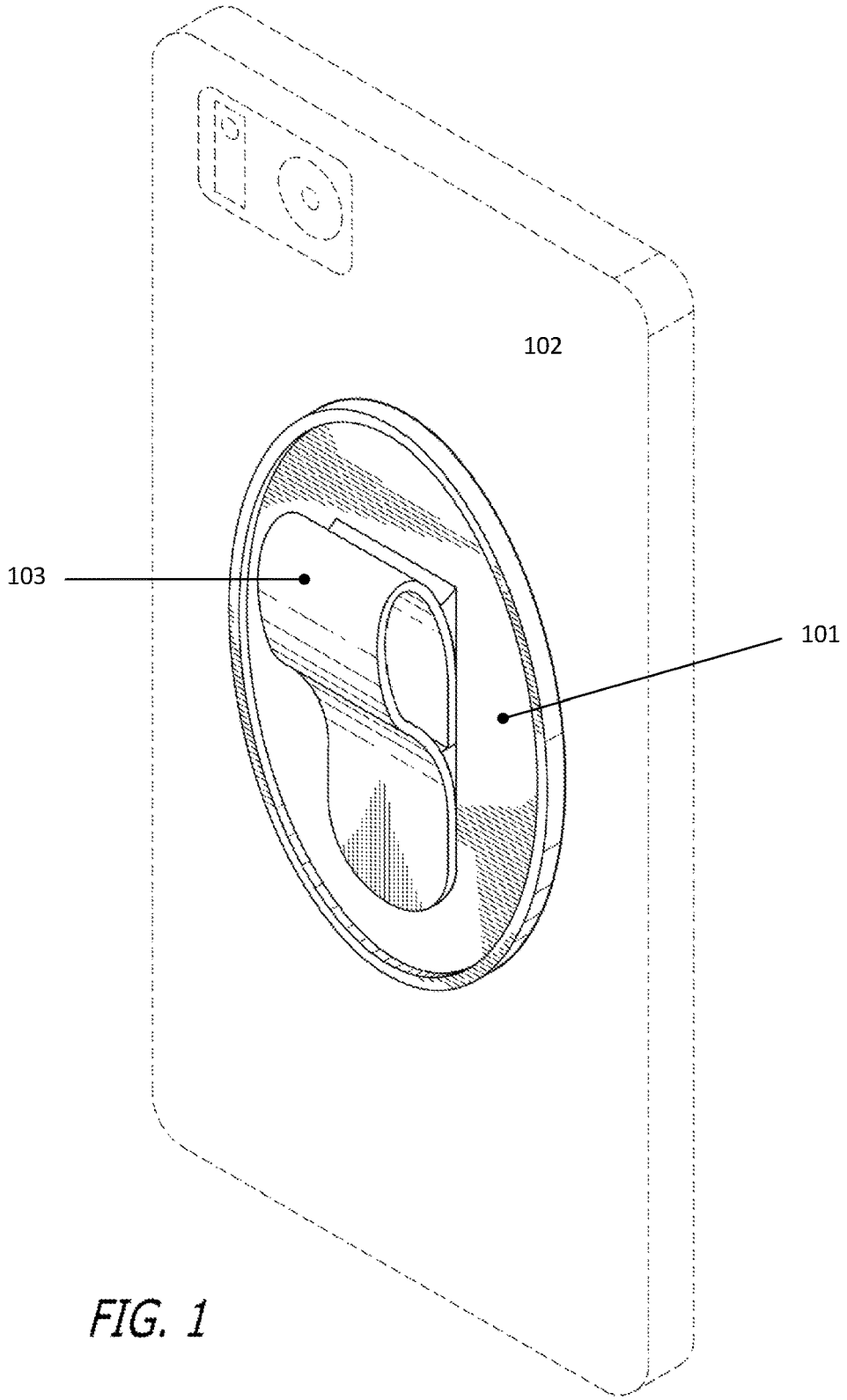
FIG. 1 is a perspective view of one embodiment of the present design.

FIG. 1 illustrates a first aspect of the present design showing a perspective view of one embodiment of the design. According to FIG. 1 there is provided a back or backing 101 that can take various forms, including circle, oval, square rectangle, diamond, or an irregular shape, but virtually any shape may be employed. The other side of the backing, not shown in FIG. 1, may include an adhesive that allows joining to the device 102 in a secure manner. Virtually any means for joining may be employed, including the aforementioned adhesive as well as a mechanical joining arrangement, such as clips or other connectors that premix affixation to the device 102, tape, glue, or even connections to an intermediate device such as a device cover, including but not limited to pins, screws, and the like, or any other devices, apparatus, systems or arrangements known in the field. In one instance, a cover may be made of a deformable material, placed with the device 102, such as engaging the device as a cover, and the backing 101 may be simply screwed into the deformable material. The joining adhesive or apparatus or other arrangement typically and preferably securely connects the backing 101 to the device 102.

The apparatus also includes strap 103. Strap 103 has been sized to enable a typical user to easily "flip" the phone using a single finger and its dimensions have been thoroughly investigated. A typical current smartphone ranges in size from about 115.2 mm by 58.6 mm (Apple iPhone 4/4S) to about 162.9 mm by 80.7 mm (Samsung C9 Pro) with certain phones having one or the other dimension greater than the Samsung or less than the Apple. Weights for Apple devices, which are somewhat representative of all smartphone devices offered, range from approximately 113 g to 202 g. Some devices are larger or smaller than these weights. Even though these devices tend to range in size and weight, they are not as large as what have been called "tablet" devices, and the current design is primarily directed to attachment to smartphone sized, and in some cases smaller, designs. Smaller designs may include portable music devices such as iPods or similar designs.

Figure 2:
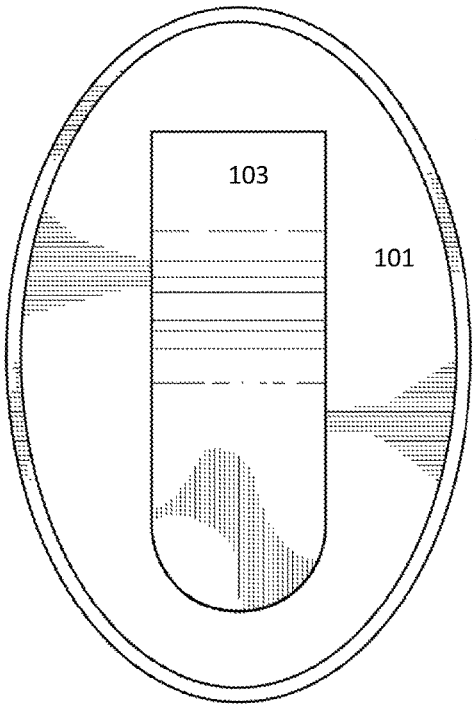
FIG. 2 is a front view of one embodiment of the present design.
Figure 3:
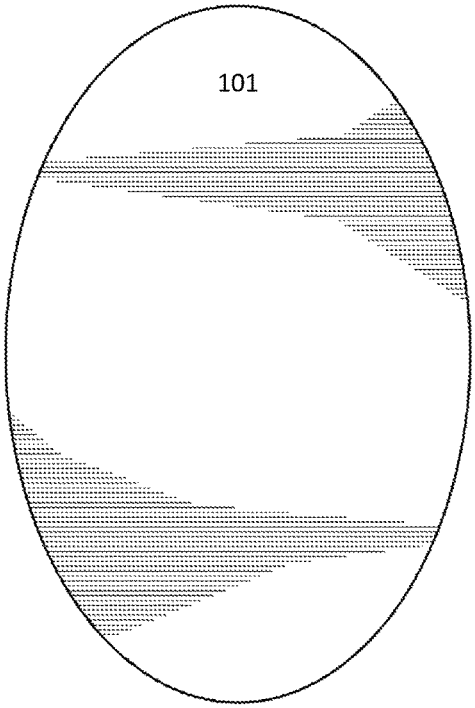
FIG. 3 is a rear view of one embodiment of the present design.

FIG. 2 is a front view of one embodiment of the present design, while FIG. 3 is a rear view showing the backing, which may include an adhesive or other material intended to join the device to the phone or electronic device. FIG. 4 is a right side elevation view of one embodiment of the device, FIG. 5 a left side elevation view, FIG. 6 a top view, and FIG. 7 a bottom view of this embodiment of the design.

Figure 8:
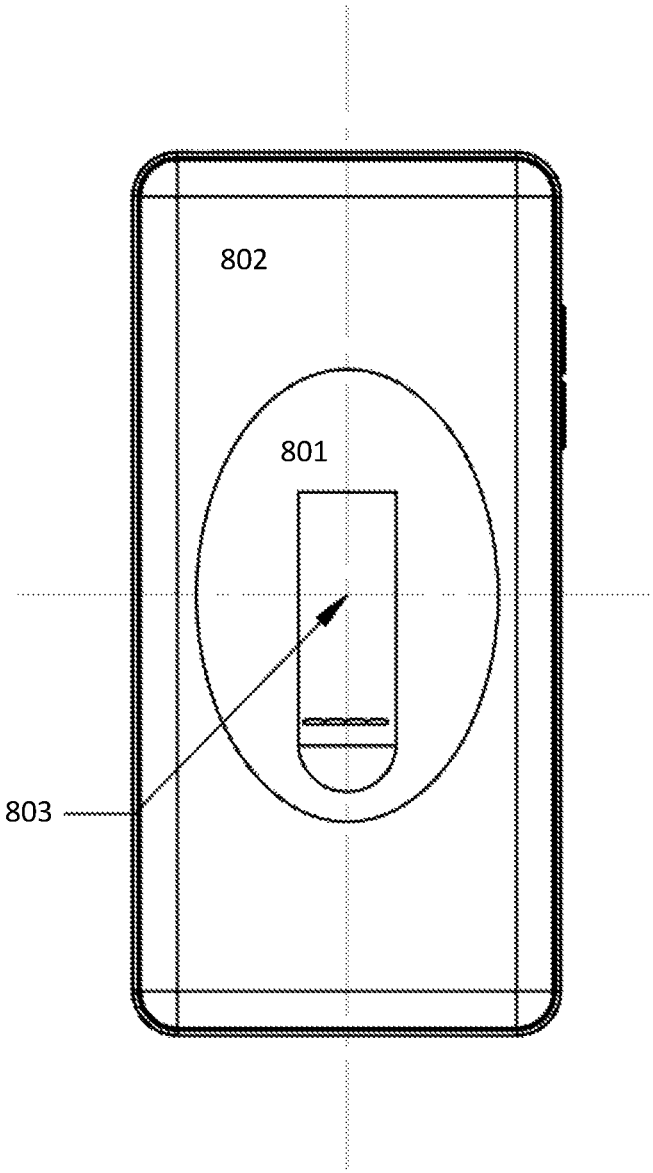
FIG. 8 is a rear view of the device attached to a smartphone.
Figure 9:
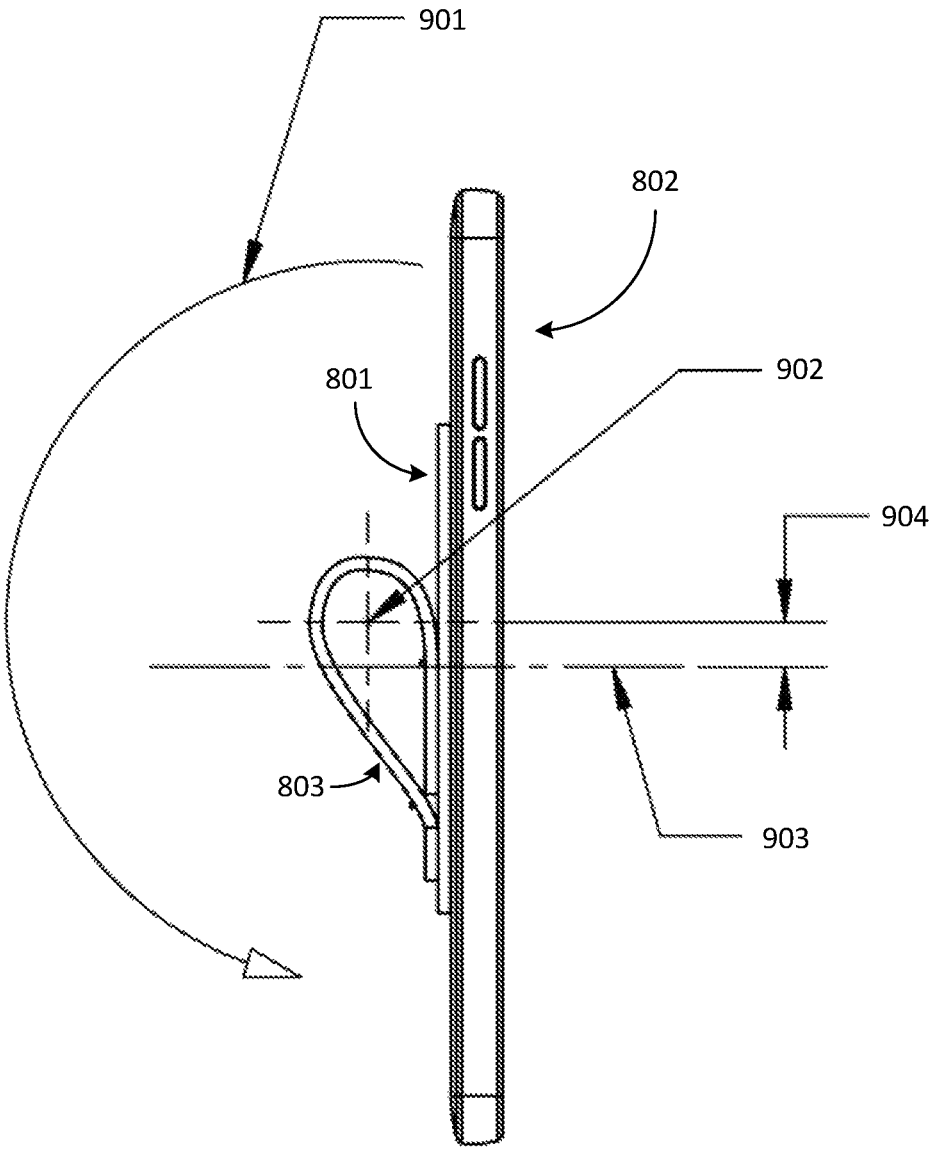
FIG. 9 is a side view of one embodiment of the current design showing the offset separation and the rotation employed.

FIG. 8 is a rear view of the design attached to phone device 802, including base 801 and strap 803. In a typical arrangement, the device is attached as closely as possible to the center of the rear of the device. FIG. 9 shows phone 802, representing any appropriately sized electronic device, with backing 810 and loop 803 shown. Also shown, and pertinent to this design for the ability to "flip" the device, is the direction of motion 901, axis of rotation 902, the phone centerline 903, and the offset separation 904 desirable to facilitate rotational acceleration. It is intended that the center of backing or base 801 be positioned slightly offset vertically from the centerline of the smartphone or electronic device as shown, such as with separation 904.

In operation, the electronic device, e.g. smartphone, may be held with the forefinger through the loop with at least one other finger, such as the pinky and/or middle finger, used for setting the user's angle of comfort for viewing. The intent is for a user to maintain use of the hand for gripping objects while the cell phone is retained hanging from the forefinger. One aspect of the design is its novel use of the center of gravity of the cell phone and changes in location of a fulcrum.

Reference is directed to the slidable movement of the forefinger from one side of the center of gravity to the other side. This results in an improved stability and a more secure feel when the cell phone is flipped from viewing mode to its mode where objects can be gripped or held. A single strap, or loop, or loop strap, without the ability to change its fulcrum may at times require the use of the other hand to assist in rotation. Comparative testing has shown that the design is stable when used with only one hand.

Figure 10:
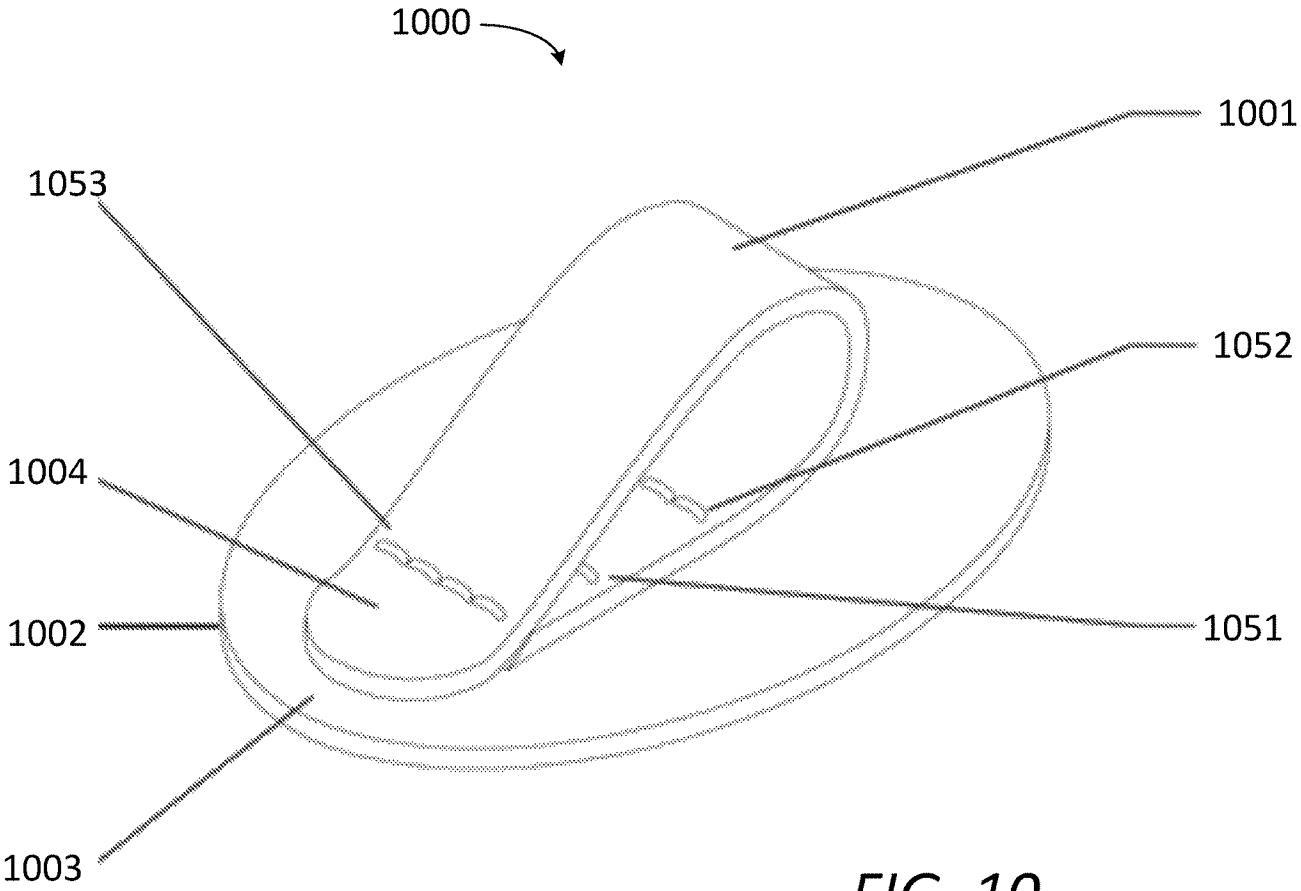
FIG. 10 is a perspective view showing relevant parts of attachment of the loop to the base of the device.

FIG. 10 shows the specific dimensions of the loop. FIG. 10 includes a view of the device 1000 including loop 1001 and base 1002. In order to provide the rotational functionality discussed herein, including the desired axis of rotation when employed with a small electronic device such as a smartphone, the present design includes a loop 1001 having particular dimensioning. Loop 1001 may be constructed of any appropriate material, and in one instance non-phthalate PVC may be employed.

Figure 11:
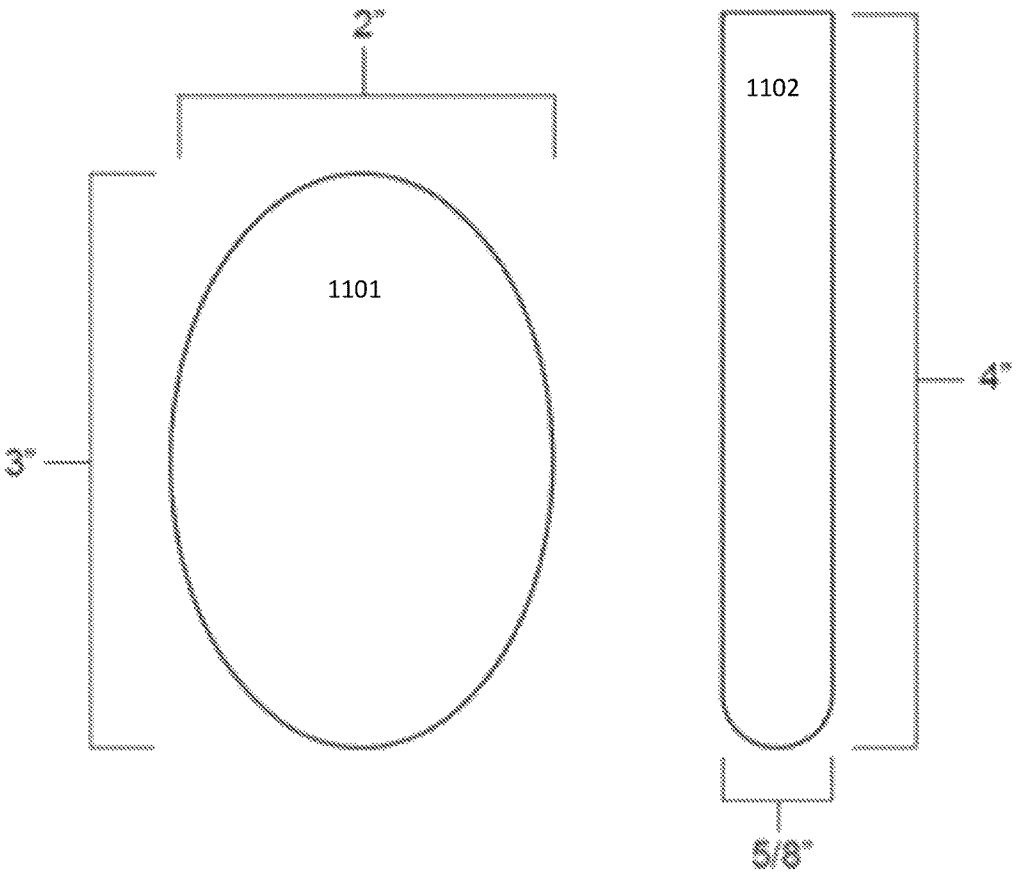
FIG. 11 shows the component parts of one embodiment of the design.

Sew line 1053 is a line approximately ⅜ of an inch wide, and in one embodiment exactly ⅜ of an inch wide, but generally plus or minus 20 percent of that figure. Loop distal end 1004 may be any length between the curved end shown in FIG. 10 and the sew line 1053. In one instance loop distal end may be approximately ½ inch in length between end and third sew line 1053, plus or minus 20 percent. In one instance, the space between the curved end of loop distal end 1004 may be ¼ inch from the edge of backing or base 1002. Finger loop 1001 runs unimpeded and unbound between third sew line 1053 to second sew line 1052 and is generally ⅝ inch wide, 2 mm thick, and finger loop 1001 may be, in its entirety, approximately 4 inches long. Finger loop 1001 may have exactly these dimensions or within plus or minus 20 percent of these numbers or some other value as discussed herein. Thus the length of finger loop 1001, from tip to tip as shown in FIG. 11, may be anywhere from 3.2 inches to 4.8 inches in length, and may range less, such as 4.5 or 3.5 inches in length, or may be any other value, such as 4.1, 4.2, 3.9, or 3.8, depending on the person using the device and/or the size of phone used. In short, an approximately 4 inch length is used to provide the functionality discussed herein.

Second sew line 1052 is approximately ⅜ inch wide, and in one embodiment is not stitched to the edge to avoid tearing of the material. Again, this may be plus or minus 20 percent in sizing. Third sew line 1053 is also provided, again having the same general widths and dimensions as first sew line 1051 and second sew line 1052.

Figure 12:
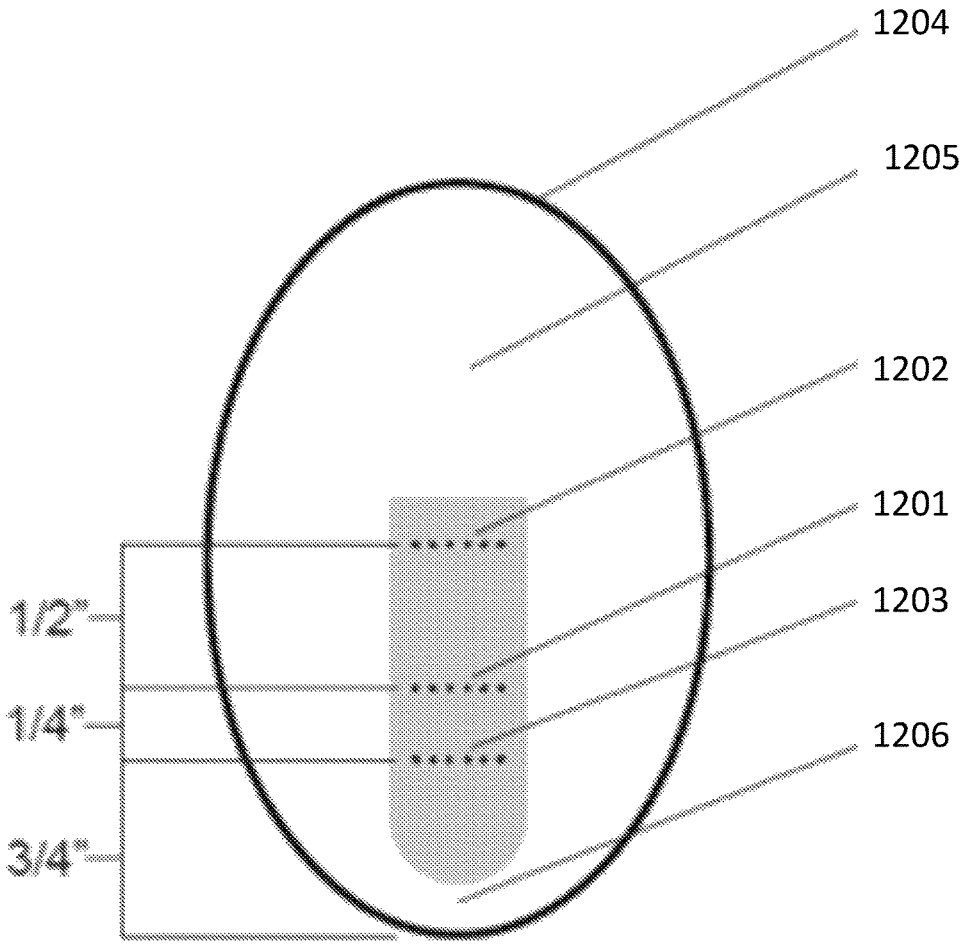
FIG. 12 illustrates positioning of various sew lines in one embodiment of the design.

FIG. 11 shows the basic dimensions employed, with a base 1101 approximately 2 inches wide and 3 inches high, plus or minus 20 percent or that amount exactly or close to that amount. Loop 1102 is 4 inches long and ⅝ inches wide in this view, and may be slightly larger or smaller or within 20 percent. In such a construction, the sew lines are positioned as shown in FIG. 12, where in the case of a 3 inch by 2 inch base, the third sew line 1203 is ¾ inch from the bottom 1206 of base 1204 in this view, first sewing line 1201 is ¼ inch from third sewing line 1202, and second sewing line 1202 is ½ inch from first sewing line 1201. Hence second sewing line 1202 is 1½ inches from the bottom 1206 of base 1204 in this embodiment, where as shown in FIG. 10, first sew line 1051 and second sew line 1052 bind one end of loop 1001, the loop 1001 is folded or provided as shown in FIG. 10, and third sew line 1053 sews the distal end of loop 1001 to the base 1002. Thus to construct the device of this embodiment, the squared off or beveled end of loop 1001 is placed on the base 1003, first and second sew lines 1051 and 1052 applied, the loop formed and third sew line 1053 applied to create the loop and finish the design.

Relative positions of the loop are noteworthy. For an approximately four inch loop, and a 3 inch high base, the squared end of the loop may be placed on the base and the first sew line 1201 applied, followed by the second sew line 1202 ½ inch from the first sew line 1201 so applied, the loop formed and the third sew line 1203 applied to the distal rounded end as shown in FIG. 10. Thus for an approximately four inch loop of material applied to base 1204, the near end of loop 1001 is placed on the position where third sew line 1203 will go, first sew line 1201 applied, 1 inch from the bottom 1206 of base 1204, followed by application of second sew line 1202 ½ inch from first sew line 1201 and 1½ inch from the bottom 1206 of base 1204. The loop 1001 is folded over and formed, and third sew line 1203 applied ¾ inch from the bottom 1206 of base 1204 and ¼ inch from first sew line 1201. This forms the device shown in FIG. 10. Surface 1205 of base 1204 may include a graphic, such as a direct four color print onto the material, which may be 2 mm thick non-phthalate PVC or other material having different dimensions but providing the same or similar functionality.

The base, such as base 1204, may therefore be formed of any appropriate material and may include 2 mm thick non-phthalate PVC in one embodiment, and the back side of the base 1204 may include an adhesive such as 3M 9465 PC double sided adhesive, manufactured and sold by 3M Corporation. In one embodiment, the squared end of loop 1001 may be beveled at an angle to "tuck" below the distal rounded end of loop 1001, with the beveling shown in FIG. 10. In other embodiments, the end may be squared off or otherwise provided, and third sew line 1203 may be applied proximate to this beveled, squared or otherwise provided end.

Hence for a four inch length of loop material, a first sew line at the ¼ inch point of the loop material may be provided and a second sew line at the ¾ inch point, ½ inch from the first sew line, followed by loop material for 2¾ inch, unimpeded and unbound, before the sewing of third sew line ¼ inch behind first sew line forms the device. So of a four inch piece of material, 2¾ inch, or approximately 68.75 percent of the material, forms the loop between the second sew line and third sew line, enabling the efficient "flipping" of the current design. Other dimensions may be employed, but differences of 1%, 2%, 5%, 10%, or 20% of any dimension mentioned may be employed in any combination. For example, one dimension may be identical or similar to the dimension recited herein, while another dimension may vary 1%, 2%, 5%, 10% or 20% from the dimension provided herein.

To be clear, as used herein, the term "approximately" means one of a difference of 1%, 2%, 5%, 10% or 20% from the measurement provided. Use of the term "proximate to" means near or close to, and in some cases at the same point or line. Thus the phrase "attached [or joined] at a line proximate to an end" in this context means the element is provided on or at the line or near the line, where near means approximately at the line, i.e. one of a difference of 1%, 2%, 5%, 10% or 20% from the identified item. Further, as used herein, terms such as "phone" "device" "smartphone" "electronic device" and the like are employed, and such terms are not intended to be limiting but to represent any of the class of products to which the current design may be attached.

Figure 13A:
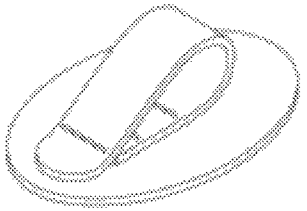
FIGS. 13A through 13H show four different styles of bases, each with a loop in perspective and front view.
Figure 13B:
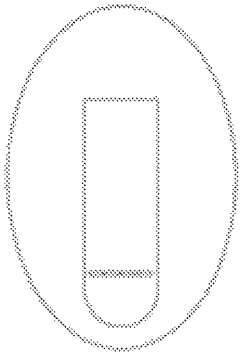
Figure 13C:
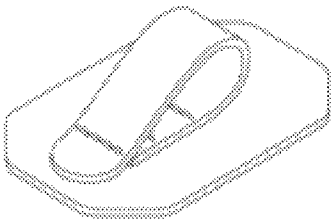
Figure 13D:
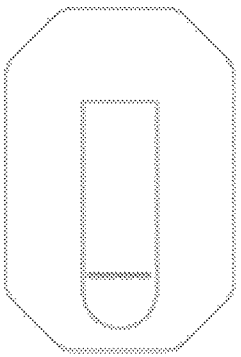
Figure 13E:
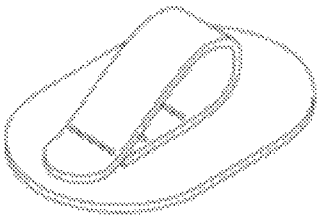
Figure 13F:
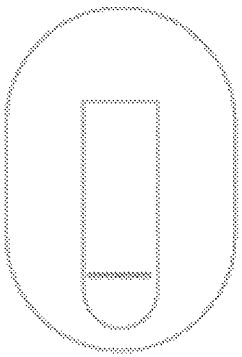
Figure 13G:
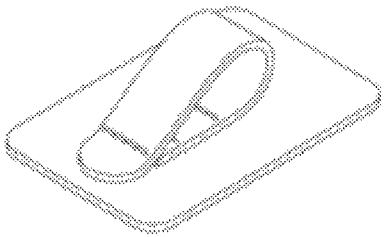
Figure 13H:
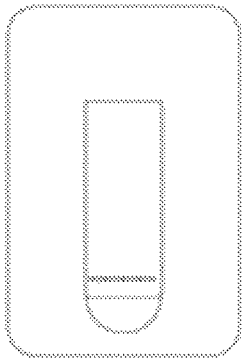

FIGS. 13A through 13H show a number of different base designs. FIGS. 13A and 13B show a first base design in perspective and front view, respectively, and is called the "oval" design. FIGS. 13C and 13D show a first alternate base design in perspective and front view, respectively, and is called the "ticket" design. FIGS. 13E and 13F show a second alternate base design in perspective and front view, respectively, and is called the "tag" design. FIGS. 13G and 13H show a third alternate base design in perspective and front view, respectively, and is called the "rectangle" design. As noted, virtually any reasonable shape base may be employed including ones not pictured here. One particular consideration is the offset separation between the device or smartphone centerline and the loop axis of rotation reflected in FIG. 9, but using that relationship, essentially any base shape that can accommodate a similar loop is acceptable for use in the current design.

While attachment is primarily described herein with respect to sew lines and sewing, it is to be understood that attachment can be provided in any appropriate manner, including but not limited to use of adhesives, rivets, clips, staples, and/or any other reasonable means for joining. In all instances, three points of adjoining are preferably provided, but more points may be employed, and if some form of adhesive is applied or some other means that cover a larger space, fewer than three may be employed.

Figure 14:
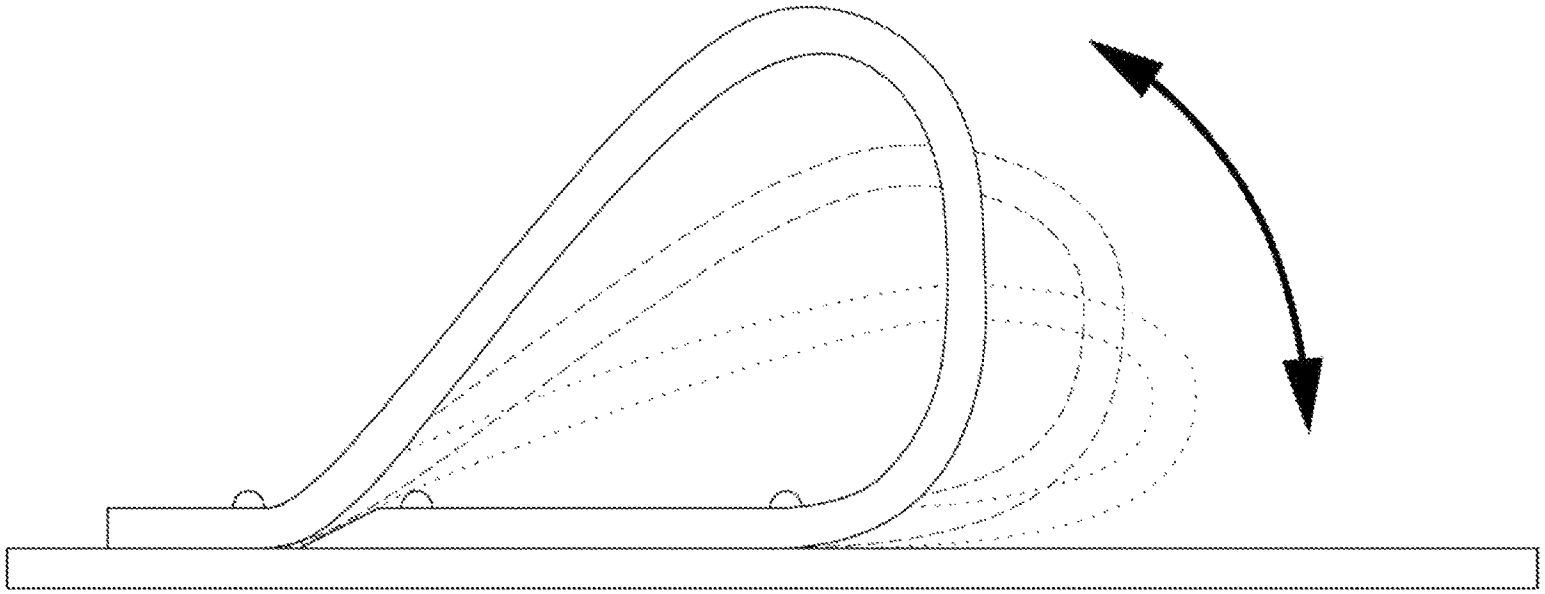
FIG. 14 illustrates various positions of the loop when employed/flipped.

It is noted that the resiliency of the loop formed in the device allows the fulcrum, here the index finger, to change its pivotal location thereby also moving its point of axis relative to the center of gravity of the device. FIG. 14 shows the resilient loop extended by the centrifugal force of the device that allows the finger more room to change its center of rotation. Dynamic stretching in this construction and in this manner allows the pivot to move relative to the center of gravity of the device. This change in center of rotation is an improvement over other products currently available.

From the Figures presented, it is to be understood that the product is placed at the vertical center of the smartphone's surface, but the finger loop is slightly offset from the centerline, allowing for additional rotational acceleration when the device Because of the shape and attachment orientation of the finger loop, a rounded surface is always in contact with the finger. Such a geometry acts like a collar (the finger loop) on an axle (the finger, facilitating the free rotation of the phone when being flipped. Again, the shape of the loop allows the finger to always be in contact with the rounded surface, allowing for easy rotation of the phone.

Figure 15:
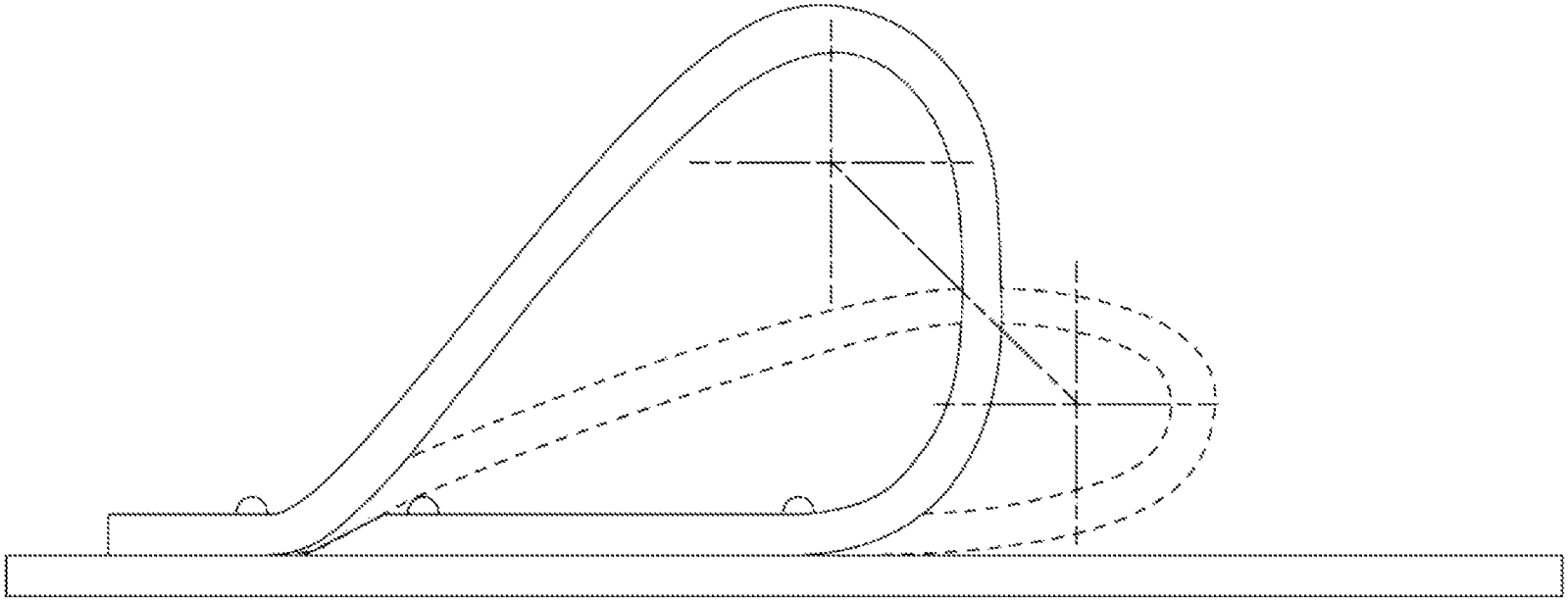
FIG. 15 illustrates changes in center of rotation in one embodiment of the current design.

When sewing is employed, one stitch on the product is positioned directly under the centerline of the phone, which is also directly under the user's finger. This stitch helps create the shape of the loop and keeps the loop attached to the device at the point of rotation, which limits the movement of the loop and facilitates rotation when flipped. Two offset stitches on the loop holds the loop in place, limiting motion of the loop, facilitating rotation of the phone when flipped. The offset distance between the two stitches maintains the necessary shape of the loop to facilitate the "flipping" action. In the sew line instance, stitching placement limits the movement of the flexible vinyl material. While a certain amount of movement or flexibility is beneficial, too much movement negatively impacts "flipping" operation. Movement of various centers of rotation is shown in FIG. 15.

Thus according to the present design, there is provided an apparatus comprising a base and a loop attached to the base. The loop has a length, and the loop is joined to the base at a first position at approximately 6.25 percent of the length from a first end and further joined to the base at a second position approximately 18.75 percent of the length from the first end. The loop comprises an unbound section of approximately 68.75 percent of the length and the loop is further joined to the base at a third position proximate the first end.

According to a further embodiment of the present design, there is provided a method for constructing an apparatus to maintain an electronic device, comprising providing a base and a loop having a length, attaching the loop to the base at a first position at approximately 6.25 percent of the length from a first end, further attaching the loop to the base at a second position approximately 18.75 percent of the length from the first end, further attaching the loop to the base at a third position proximate to the first end, thereby producing an unbound section of the loop of approximately 68.75 percent of the length and joining the base to the electronic device such that an axis of rotation formed by the loop is vertically offset from a centerline of the electronic device.

The above description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, mechanisms and methods are omitted so as to not obscure the description of the present invention with unnecessary detail.

What is claimed is:

1. An apparatus comprising:

a base; and a loop attached to the base;

wherein the loop has a length, and the loop is joined to the base at a first position at approximately 6.25 per cent of the length from a first end and further joined to the base at a second position approximately 18.75 per cent of the length from the first end;

wherein the loop comprises an unbound section of approximately 68.75 per cent of the length and the loop is further joined to the base at a third position proximate the first end;

wherein the base comprises an adhesive on a side opposite the loop.

2. The apparatus of claim 1, wherein the loop is constructed of a non-phthalate PVC material.

3. The apparatus of claim 1, wherein the base is constructed of a non-phthalate PVC material.

4. The apparatus of claim 1, wherein the first position, the second position, and the third position are sew lines.

5. The apparatus of claim 1, wherein the length is four inches.

6. The apparatus of claim 5, wherein the loop is approximately ⅝ inch wide.

7. The apparatus of claim 1, wherein the base has one of an oval, rectangular, hexagonal, and irregular shape.

8. The apparatus of claim 1, wherein the base is approximately two inches wide and three inches long.

9. The apparatus of claim 1, wherein the loop is attached to the base via at least one of sewing, riveting, clipping, and stapling.

10. A method for constructing an apparatus to maintain an electronic device, comprising:

providing a base and a loop having a length;

attaching the loop to the base at a first position at approximately 6.25 per cent of the length from a first end;

further attaching the loop to the base at a second position approximately 18.75 per cent of the length from the first end;

further attaching the loop to the base at a third position proximate to the first end, thereby producing an unbound section of the loop of approximately 68.75 per cent of the length; and joining the base to the electronic device such that an axis of rotation formed by the loop is vertically offset from a centerline of the electronic device.

11. The method of claim 10, wherein the loop is constructed of a non-phthalate PVC material.

12. The method of claim 10, wherein the base comprises an adhesive on a side opposite the loop.

13. The method of claim 10, wherein the base is constructed of a non-phthalate PVC material.

14. The method of claim 10, wherein the first position, the second position, and the third position are sew lines.

15. The method of claim 10, wherein the length is four inches.

16. The method of claim 15, wherein the loop is approximately ⅝ inch wide.

17. The method of claim 10, wherein the base has one of an oval, rectangular, hexagonal, and irregular shape.

18. The method of claim 10, wherein the base is approximately two inches wide and three inches long.

19. The method of claim 10, wherein the loop is attached to the base via at least one of sewing, riveting, clipping, and stapling.

* * * * *